US006443220B1

(12) United States Patent
Hohenbichler et al.

(10) Patent No.: US 6,443,220 B1
(45) Date of Patent: Sep. 3, 2002

(54) METHOD OF PREVENTING CONTACT OF OXYGEN WITH A METAL MELT

(75) Inventors: Gerald Hohenbichler, Kronstorf; Stefano Pellissetti, Linz, both of (AT); Romeo Capotosti, Narni; Riccardo Tonelli, Rome, both of (IT)

(73) Assignees: Voest-Alpine Industrieanlagenbau GmbH (AT); Acciai Speciali Terni S.p.A. (IT)

( * ) Notice: Subject to any disclaimer, the term of this patent is extended or adjusted under 35 U.S.C. 154(b) by 0 days.

(21) Appl. No.: 09/367,473

(22) PCT Filed: Feb. 12, 1998

(86) PCT No.: PCT/EP98/00787

§ 371 (c)(1),
(2), (4) Date: Aug. 13, 1999

(87) PCT Pub. No.: WO98/35772

PCT Pub. Date: Aug. 20, 1998

(30) Foreign Application Priority Data

Feb. 14, 1997 (IT) ..... RM97A0078

(51) Int. Cl.[7] ..... B22D 11/00; B22D 11/06

(52) U.S. Cl. ..... 164/475; 164/415; 164/428; 164/480

(58) Field of Search ..... 164/479, 480, 164/429, 428, 475, 415

(56) References Cited

U.S. PATENT DOCUMENTS

| | | | | |
|---|---|---|---|---|
| 4,987,949 | A | 1/1991 | Sakaguchi et al. | 164/450 |
| 5,563,903 | A * | 10/1996 | Jebrail et al. | 373/22 |

FOREIGN PATENT DOCUMENTS

| | | |
|---|---|---|
| DE | 3602594 | 7/1987 |
| EP | 0040072 | 11/1981 |
| EP | 0409645 | 1/1991 |
| EP | 0430841 | 6/1991 |
| EP | 0523643 | 1/1993 |
| EP | 0526886 | 2/1993 |
| EP | 0568211 | 11/1993 |
| EP | 0714716 | 6/1996 |
| JP | 59-166356 | 9/1984 |
| JP | 4-300049 | 10/1992 |
| WO | 87/06166 | 10/1987 |

* cited by examiner

*Primary Examiner*—Kuang Y. Lin
(74) *Attorney, Agent, or Firm*—Ostrolenk, Faber, Gerb & Soffen, LLP

(57) ABSTRACT

In a method of preventing contact of oxygen with a metal melt, metal melt flows into a casting chamber bounded by walls (1, 2, 13) and leaves this chamber as a stream. In order to completely prevent contact of oxygen with a metal melt and thus reoxidation, oxygen attempting to enter via any gaps (18) between the walls (1, 2, 13) and/or adhering to the walls (1, 2) is reacted to form a compound which is not injurious to the metal melt (20).

20 Claims, 2 Drawing Sheets

3 4

METHOD OF PREVENTING CONTACT OF OXYGEN WITH A METAL MELT

The invention relates to a method of preventing contact of oxygen with a metal melt during continuous casting, in which the metal melt flows into a casting chamber bounded by walls and leaves this chamber as a stream, and also an apparatus for implementing the method.

In continuous casting, metal melt accumulates in the casting chamber and has to be protected against reoxidation and its bath surface has to be protected against high radiative heat loss. In conventional continuous casting, the bath surface is covered with casting powder or with an oil for this purpose.

For the casting of thin strips, various casting processes in which the casting chamber is formed not by rigid walls, but of a wall which moves with the stream or a plurality of walls which move with the stream, for example using a caterpillar chain as described in EP-A-0 526 886 or a roll as described in EP-A-0 568 211 or EP-B-0 040 072 or contrarotating casting rolls as described in U.S. Pat. No. 4,987,949 or EP-B-0 430 841, are known. In these methods, it is not possible to protect the metal melt reliably against reoxidation or heat loss by means of a casting powder or oil as is usually the case for casting chambers or casting dies having rigid walls.

EP-B-0 430 841 discloses, in the case of a two-roll casting unit, protecting the bath surface against excessively high radiative heat loss and against reoxidation by provision of a covering hood. However, for this solution it has been found that severe wear occurs at the contact surfaces between covering hood and casting rolls both on the covering hood and on the casting rolls and that, as a result of thermal deformation of the components, the entry of air and thus of oxygen through gaps between the walls bounding the casting chamber cannot be prevented. This results in reoxidation of the melt with all its disadvantages. To minimize the entry of air through the gap between covering hood and casting rolls, U.S. Pat. No. 4,987,949 and EP-A-0 714 716 propose blowing an inert gas, preferably nitrogen or argon, into a defined gap between covering hood and casting rolls and thus to produce a barrier against intrusion of air. However, this measure is not sufficient to completely prevent air from entering the casting chamber and thus reaching the bath surface, so that, on the one hand, metal oxides are still formed at the bath surface and these lead to defects in the interior of the metal strip. On the other hand, metal oxides are formed at the surface of the solid shell forming around the stream or oxygen diffuses into the outer layer of the metal strip and there forms inclusions which increases the susceptibility to cracks. Despite the feeding-in of inert gas, air entrained in the microroughness of the roll surface is carried into the casting chamber in the laminar sublayer of the flow boundary layer. This sublayer adheres in the microroughness of the roll surface and can be stripped off neither by contacting, sliding seals nor by non-contact seals.

JP-A2 4-300049 discloses a sealing device between two contrarotating casting rolls and a covering hood in a two-roll casting process, which is penetrated by an inert gas feed facility and a fuel gas feed facility. Here, the casting rolls rotating towards the melt bath are, in a first treatment step, flushed with inert gas, which prevents access of relatively large amounts of atmospheric oxygen to the melt bath. In a further treatment step, the atmospheric oxygen which nevertheless enters the gap between casting roll surface and sealing device is burnt using fuel gas. However, this solution does not prevent the entry of combustion gases, and thus also not the entry of remaining oxygen, into the melt chamber. Combustion which is so complete that no residual oxygen remains cannot be ensured.

SUMMARY OF THE INVENTION

The invention makes it possible to avoid these disadvantages and difficulties and has the object of providing a method of the type described at the outset and an apparatus for continuous casting by means of which contact of oxygen with a metal melt can be prevented and which method and apparatus completely prevent reoxidation even when considerable wear occurs at the gaps between the walls forming the casting chamber. In particular, it should also be possible to remove the laminar sublayer, i.e. the air layer carried with or adhering to walls forming the casting chamber, and to avoid the introduction of combustion gases containing residual oxygen.

This object is achieved in a method of the type described at the outset by, after combustion of the fuel gas, an inert gas being applied to the casting roll surface which has been freed of oxygen thereby.

To keep even very small amounts of oxygen away from the metal melt, the combustion is advantageously carried out stoichiometrically or substoichiometrically, i.e. with an oxygen deficiency; the combustion is preferably carried out at from 1 to 50% below stoichiometric.

As fuel gas, use is advantageously made of gaseous hydrocarbon such as methane, acetylene, etc., or mixtures thereof or else forming gas such as $N_2H_2$ mixed gases.

To cope with different operating conditions in continuous casting, it is advantageous to carry out a measurement of the chemical composition of the gases formed in the combustion and, on the basis of this result, to regulate or control the reaction, for example by setting the ratio of amount of fuel gas to amount of oxygen required for the combustion process.

A further preferred embodiment is characterized in that the oxygen is burnt by means of gases and/or liquids, where the gases or liquids are advantageously supplied at a temperature of from 0 to 300° C., preferably preheated, and are advantageously supplied at a pressure of from 0.5 to 5 bar. Hydrocarbons are particularly advantageous for this purpose.

A further preferred embodiment is characterized in that, directly adjacent to the zone of oxygen combustion on a wall bounding the casting chamber, the inert gas flows in a layer having a thickness of at least 0.5 mm, preferably at least 5 mm, and preferably at a flow pressure between 0.6 to 1.5 times, preferably between 0.95 and 1.05 times, atmospheric pressure against the wall.

An apparatus by means of which contact of oxygen with a metal melt is prevented in the continuous casting of a metal strip, preferably a steel strip, by the two-roll casting process comprises two contra-rotating casting rolls having parallel roll axes and two side dams which together form a casting chamber for accommodating molten metal and having a covering hood which is located above the casting chamber and closes off the latter at the top, and also having a sealing device which prevents entry of air into the casting chamber along a gap formed by the covering hood and the rotating casting rolls, a fuel gas feed facility and an inert gas feed facility, is characterized in that the sealing device is formed by a burner, preferably a gas burner, located on the atmosphere side in the vicinity of the gap between the rotating casting rolls and the covering hood and in that an inert gas feed facility is located between the covering hood and the burner.

An advantageous embodiment of the burner is for the burner to comprise a fuel gas chamber located at a distance from the casting roll surface and extending in the direction of the casting roll axis and to be provided with a feed line for fuel gas and at least one outlet opening for fuel gas directed at the casting roll surface, preferably obliquely and counter to the direction of motion of the casting rolls. The outlet opening for fuel gas can be configured either as a slit nozzle or as a round nozzle. To achieve complete combustion of the atmospheric oxygen, it is important that a continuous flame front is maintained in front of the gap formed by the covering hood and the casting roll.

To be able to control the combustion in a targeted way, it is advantageous for the outlet openings for the fuel gas to open into a flame chamber which is open on the side facing the casting roll surface. This additionally makes it possible to reduce the consumption of fuel gas, since the flame chamber and the casting roll surface create a largely closed space in which inflow of air can occur only through the gap between the wall of the flame chamber and the casting roll surface. The effectiveness of the flame chamber is improved by it being connected to an air feed line and having a connection for a gas analysis apparatus. The feeding-in of air makes targeted control of the combustion as a function of the flue gas composition determined by the gas analysis apparatus possible.

According to a particular embodiment, the inert gas feed facility has an outlet opening configured as a nozzle which is directed at the casting roll surface, preferably obliquely and counter to the direction of motion of the casting roll surface. By means of this measure, an inert gas layer close to the roll is applied to the casting roll and excellent protection against access of oxygen or air is thus produced. If an inert gas layer of a few millimetres in thickness is applied to the casting roll and use is made of an inert gas which has a density higher than that of air, it is not necessary for the covering hood to directly adjoin the inert gas feed line and the burner.

It is advantageous for a seal, preferably a lamellar seal, to be provided between burner and inert gas feed facility.

Further features and advantages may be seen from the following description of the apparatus and the method of casting a metal strip in a plurality of embodiments:

DETAILED DESCRIPTION OF THE EMBODIMENTS

Figure 1:
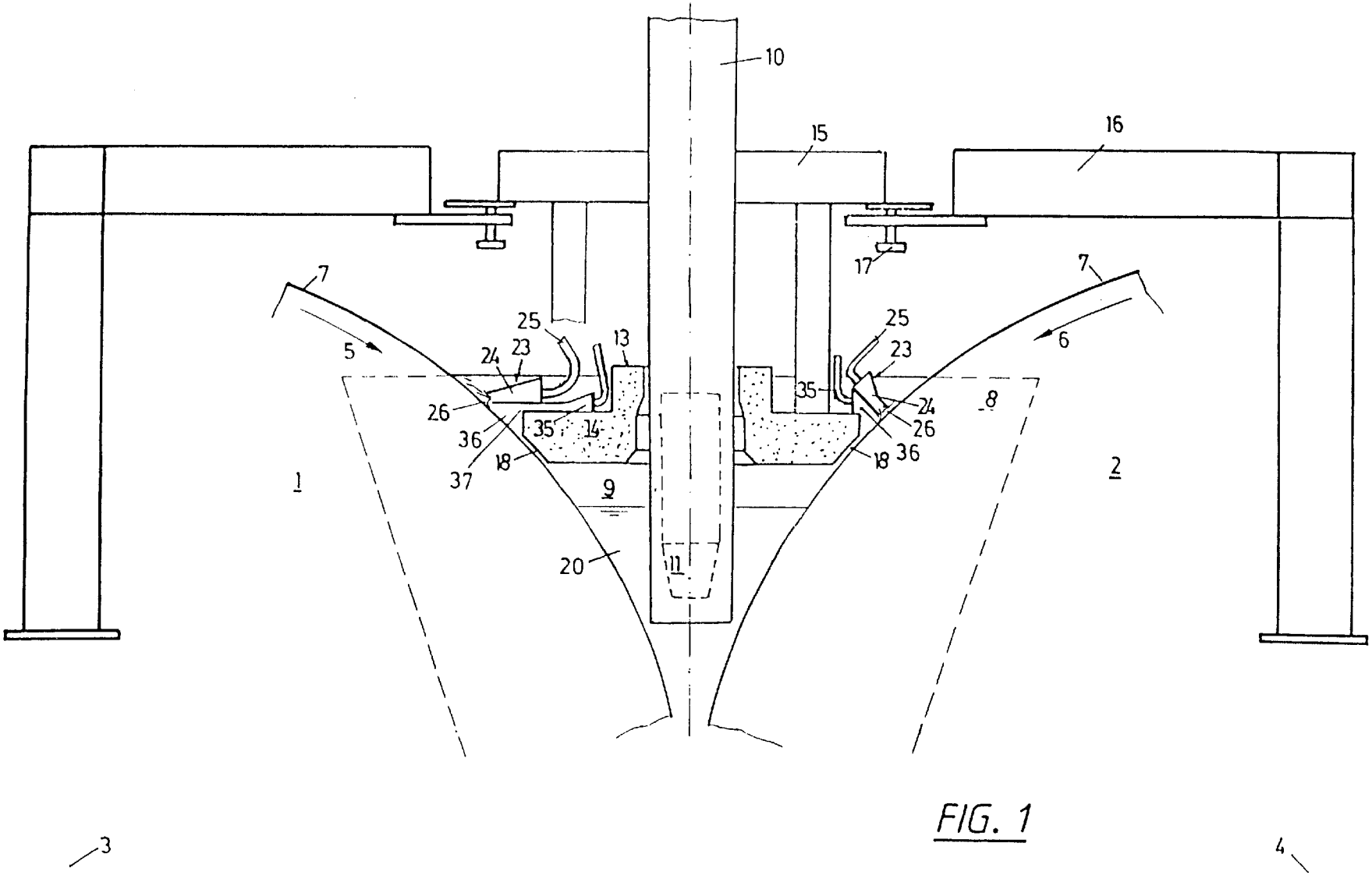
FIG. 1 shows a cross section through the two-roll casting plant with the sealing device of the invention in two embodiments.

The two-roll casting plant as is shown schematically in section in FIG. 1, has two powered casting rolls 1, 2 whose parallel roll axes 3, 4 lie in a horizontal plane. The two contrarotating, in the direction of the arrows 5, 6, casting rolls 1, 2 are provided with internal cooling (not shown) for the casting roll wall which forms the casting roll surface 7. At the end faces, side dams 8 are arranged sufficiently close to the casting rolls 1, 2. The casting rolls 1, 2 and the side dams 8 form a casting chamber 9 into which melt 20 is introduced from a melt container or distributor vessel (not shown) via a feed nozzle 10 provided with outlet openings 11. The casting chamber 9 is bounded at the top, relative to the casting rolls 1, 2 and relative to the side dams, by a covering hood 13 which has a refractory lining 14 on the melt side in order to protect the melt 20 from excessively large heat losses and against reoxidation by atmospheric oxygen. By means of a support device 15 for the covering hood 13, which is adjustable relative to a stationary frame 16 by means of adjusting elements 17, a desired minimum gap 18 between the covering hood 13 and the casting rolls 1, 2 is set. The covering hood 13 is penetrated by the feed nozzle 10, with a very small annular gap which is possibly covered by a seal, being provided between these two components.

Using a two-roll casting plant having this configuration, it is possible to cast a thin metal strip, in particular a steel strip having a thickness of from 1 mm to 12 mm, with the melt 20 to be cast being introduced continuously, as described above, into the casting chamber 9. At the contrarotating and cooled casting rolls 1, 2, there is increasing formation of stream shells which are, in the narrowest cross section between the casting rolls, joined to a strip shaped by the casting rolls. The thickness of the strip conveyed out by the casting rolls is determined by the mutual spacing of the casting rolls.

To prevent entry of air into the casting chamber along a gap 18 formed by the covering hood 13 and the rotating casting rolls 1, 2, a gas burner 23 is arranged in front of these gaps 18. The gas burner comprises a fuel gas chamber 24 extending in the direction of the casting roll axis, is connected to a feed line 25 for fuel gas and has an outlet opening 26 for fuel gas directed at the casting roll surface. According to the embodiment shown in the right-hand half on FIG. 1, the outlet opening 26 from the fuel gas chamber 24 is directed radially towards the casting roll surface 7 of the casting rolls 2. According to the embodiment shown in the left-hand half of FIG. 1, the outlet opening 26 from the fuel gas chamber 24 is directed obliquely and counter to the direction of motion of the casting roll surface 7. The outlet opening 26 is configured as a slit nozzle, with the slit-shaped outlet opening extending in the direction of the casting roll axis 4. The outlet opening 26 can, of course, also consist of a plurality of shorter slits arranged behind one another which together extend over the entire length of the casting roll. Alternatively, round nozzles are also possible, with these nozzles being made up of a large number of drilled holes arranged next to one another in the wall of the fuel gas chamber opposite the casting roll surface.

Figure 2:
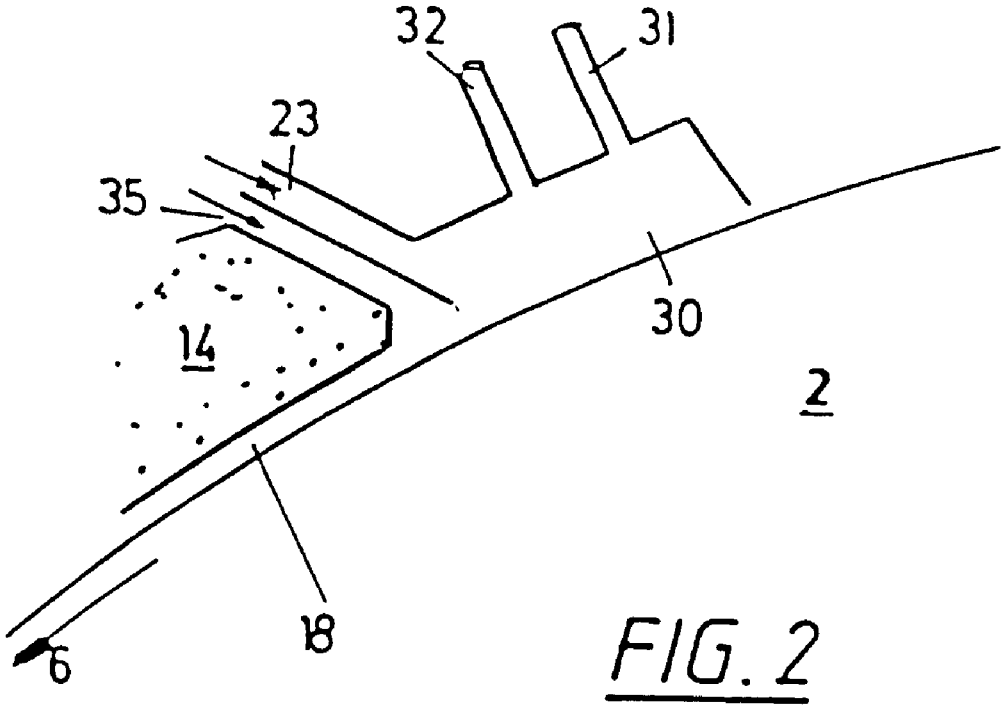
FIG. 2 shows a section from FIG. 1 of the burner of the invention having a flame chamber.

FIG. 2 shows, in a section, the burner 23 already known from FIG. 1, where the outlet opening 26 from the fuel gas chamber 24 opens into a flame chamber 30. Only in the flame chamber 30, which is formed by a U-shaped housing, are the introduced fuel gases ignited and the oxygen carried in is burnt. The flame chamber 30 is sealed against the casting roller surface 7 by means of a contacting lamellar seal to prevent excessive entry of air. The flame chamber 30 is connected to an air feed line 31 and has a connection 32 for a gas analysis apparatus.

Between the covering hood 13 and the burner 23, there is located an inert gas feed facility 35 which is connected to a common construction unit, whereby the possibility of erroneous air entry from this side is ruled out and independent adjustment of the inert gas feed facility 35 and the burner 23 relative to the casting roll surface is also dispensed with. The inert gas feed facility 35 is configured structurally as an inert gas chamber 36 located at a distance from the casting roll surface 7 and has an outlet opening 37 configured as a nozzle. It is, according to the embodiment shown in the right-hand half of FIG. 1, directed radially at the casting roll surface 7 and, according to the embodiment shown in the left-hand half of FIG. 1, directed obliquely and counter to the direction of motion of the casting roll surface 7.

By means of the inert gas feed facility, a thin inert gas layer is applied to the casting roll surface after combustion of the fuel gas on the casting roll surface, by means of which intrusion of combustion gases into the casting chamber 9 is prevented. This requires a layer thickness of at least 0.5 mm, preferably more than 5 mm. Optimum conditions are obtained when the flow pressure of the inert gas is set to a value between 0.6 and 1.5 times, preferably between 0.95 and 1.05 times, atmospheric pressure.

What is claimed is:

1. Method of preventing contact of oxygen with a metal melt during continuous casting by the two-roll casting process, in which the metal melt flows into a casting chamber bounded by walls and leaves the casting chamber as a stream, comprising the steps of: firstly burning oxygen which attempts to enter via any gaps between the walls and/or which is adhering to the walls to form a compound which is not injurious to the metal melt, the burning being performed by a flame formed with fuel gas that comes into direct contact with the walls of the casting chamber and, secondly directing a flow of inert gas adjacent to the combustion zone of the oxygen on a wall bounding the casting chamber after the combustion of the fuel gas, so that the inert gas is applied to the casting roll surface which has been freed of oxygen.

2. Method according to claim 1, characterized in that the combustion is carried out stoichiometrically or substoichiometrically.

3. Method according to claim 2, characterized in that the combustion is carried out at from 1 to 50% below stoichiometric.

4. Method according to claim 1, characterized in that the fuel gas used is gaseous hydrocarbon such as methane, acetylene, etc., or a mixture thereof or forming gas such as $N_2H_2$ mixed gases.

5. Method according to claim 1, including measuring the chemical composition of the gases formed in the chemical reaction and regulating a resulting reaction on the basis of this measuring step.

6. Method according to claim 1, characterized in that the oxygen is burnt by means of gases and/or liquids which are supplied at a temperature from 0 to 300° C.

7. Method according to claim 6, characterized in that the gases or liquids are supplied at a pressure of from 0.5 to 5 bar.

8. Method according to claim 5, characterized in that hydrocarbons are used for the combustion.

9. Method according to claim 1, characterized in that the inert gas flows, in a layer having a thickness of at least 0.5 mm at a flow pressure of from 0.6 to 1.5 times atmospheric pressure, against a wall bounding the casting chamber directly adjacent to the zone in which occurs combustion of oxygen.

10. Method according to claim 5, in which the measuring step includes setting the ratio of amount of fuel gas to amount of oxygen required for the combustion process.

11. Apparatus for preventing contact of oxygen with a metal melt in the continuous casting of a metal strip by a two-roll casting process, having two contrarotating casting rolls with parallel roll axes and two side dams which together form a casting chamber for accommodating molten metal and having a covering hood which is located above the casting chamber and closes off the latter at the top; the apparatus including a sealing device which prevents entry of air into the casting chamber along a gap formed by the covering hood and the rotating casting rolls, a feed line for fuel gas and an inert gas feed facility, characterized in that the sealing device is formed by a burner located on the atmosphere side in the vicinity of the gap between the rotating casting rolls and the covering hood and the inert gas feed facility is located between the covering hood and the burner, and the apparatus is controlled so that the burner is operated first to burn oxygen and then the inert gas feed facility is operated to prevent oxidation.

12. Apparatus according to claim 11, characterized in that the burner comprises a fuel gas chamber located at the distance from the casting roll surface and extending in the direction of the casting roll axis and is provided with a feed line for fuel gas and at least one outlet opening for fuel gas directed at the casting roll surface.

13. Apparatus according to claim 12, characterized in that the outlet opening for fuel gas is configured as a slit nozzle.

14. Apparatus according to claim 12, characterized in that the outlet opening for fuel gas is configured as a round nozzle.

15. Apparatus according to claim 12, characterized in that the outlet openings for the fuel gas open into a flame chamber which is open on the side facing the casting roll surface.

16. Apparatus according to claim 15, characterized in that the flame chamber is connected to an air feed facility and has a connection for a gas analysis apparatus.

17. Apparatus according to claim 11, characterized in that the inert gas feed facility has an outlet opening configured as a nozzle which is directed at the casting roll surface.

18. Apparatus according to claim 11, characterized in that a seal is provided between the burner and the inert gas feed facility.

19. The apparatus according to claim 12 which the fuel gas is directed obliquely and counter to the direction of motion of the casting rolls.

20. The apparatus of claim 18 in which the seal is a lamellar seal.

* * * * *